US007503242B2

(12) United States Patent
Hu

(10) Patent No.: US 7,503,242 B2
(45) Date of Patent: Mar. 17, 2009

(54) METHOD FOR MANUFACTURING WRENCH HANDLE WITH PRESSED INDENTATION SECTION

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 177 days.

(21) Appl. No.: 11/553,561

(22) Filed: Oct. 27, 2006

(65) Prior Publication Data

US 2007/0107553 A1 May 17, 2007

(30) Foreign Application Priority Data

Nov. 15, 2005 (TW) ..... 94140093 A
Jan. 17, 2006 (TW) ..... 95101810 A

(51) Int. Cl.
*B21K 5/16* (2006.01)
*B25B 13/00* (2006.01)

(52) U.S. Cl. ..... 76/114; 81/124.4

(58) Field of Classification Search ..... 76/101.1, 76/114; 81/124.4

See application file for complete search history.

(56) References Cited

U.S. PATENT DOCUMENTS 1,395,222 A * 10/1921 Coes ..... 76/114
1,711,083 A * 4/1929 Brungardt ..... 72/334
3,976,004 A 8/1976 England, III et al.
4,870,846 A 10/1989 Budrean et al.
5,109,737 A 5/1992 Raber
5,230,262 A 7/1993 Ahlund et al.
5,475,894 A 12/1995 Wildforster
5,826,504 A 10/1998 Elmassian
6,361,317 B1 3/2002 Rahman
6,477,759 B2 11/2002 Hu
6,523,440 B2 2/2003 Friedman et al.
6,647,834 B2 11/2003 Hu
7,028,588 B2 4/2006 Shih
7,322,261 B2 * 1/2008 Hu ..... 76/10
D562,653 S * 2/2008 Hu ..... D8/27
2005/0123723 A1 6/2005 Wang
2006/0027054 A1 2/2006 Wang
2006/0032283 A1 2/2006 Thomae et al.

* cited by examiner

*Primary Examiner*—Hwei-Siu C. Payer
(74) *Attorney, Agent, or Firm*—Alan Kamrath; Kamrath & Associates PA

(57) ABSTRACT

A method for manufacturing a wrench handle includes preheating a work piece made of metal, with a layer of carbon scale being generated on the work piece during preheating. The work piece is forged to form a wrench handle, with the carbon scale on the work piece being forged into a surface of the wrench handle during forging. The carbon scale is then removed, leaving a pitted area with a plurality of pits in the surface of the wrench handle. Finally, a concealment treatment is carried out, wherein the pitted area of the surface of the wrench handle is pressed inward to form an indentation section on the surface of the wrench handle for covering the pits.

6 Claims, 17 Drawing Sheets

METHOD FOR MANUFACTURING WRENCH HANDLE WITH PRESSED INDENTATION SECTION

BACKGROUND OF THE INVENTION

1. Field of the Invention

The present invention relates to a method for manufacturing a wrench handle with a pressed indentation section.

2. Description of the Related Art

FIG. 1 illustrates a conventional method for manufacturing a hand tool body such as a wrench body. The method comprises preheating a work piece and forging the work piece to form a wrench body. A layer of carbon scale is generated on the work piece during preheating. Referring to FIG. 2, the carbon scale 3 is forged into a surface 2 of the wrench body 1 during forging. Hence, surface cleaning is required after forging. Typically, the carbon scale 3 is removed by sand-blasting or tumbling. A plurality of pits 4 are left in the surface 2 of the wrench body 1 after surface cleaning, as shown in FIG. 3. As a result, further processing including grinding and subsequent heat treatment, polishing, and/or electroplating is required to provide a smooth surface for the purposes of attracting potential customers. However, the wrench body 1 includes arcuate portions that can only be manually ground, leading to an increase in the cost as well as poor qualified product ratio.

SUMMARY OF THE INVENTION

A method for manufacturing a wrench handle in accordance with the present invention comprises preheating a work piece made of metal, with a layer of carbon scale being generated on the work piece during preheating; forging the work piece after preheating to form a wrench handle having at least one end for driving fasteners, with the carbon scale on the work piece being forged into a surface of the wrench handle during forging; removing the carbon scale after forging and leaving a pitted area with a plurality of pits in the surface of the wrench handle, with each of the plurality of pits having a depth from the surface of the wrench handle; and providing a concealment treatment by pressing the pitted area of the surface of the wrench handle inward to a pressing depth after removing the carbon scale after forging and forming an indentation section on the surface of the wrench handle for covering the plurality of pits, with the indentation section including a first level area having a first depth to the surface of the wrench handle after pressing, the indentation section further including a second level area located at a position different from that of the first level area and having a second depth to the surface of the wrench handle after pressing, with the second depth being larger than the first depth, and with the depth from the surface after pressing of each of said plurality of pits being larger than the first depth and smaller than the second depth.

At least a portion of the layer of carbon scale may be removed before forging.

The carbon scale may be removed by sand-blasting or tumbling.

Preferably, providing the concealment treatment by pressing comprises pressing at least one of an upper face and a lower face opposite to the upper face of the wrench handle to form the indentation section.

Preferably, providing the concealment treatment by pressing comprises pressing with a force of at least ten tons to form the indentation section on the surface of the wrench handle.

Preferably, providing the concealment treatment by pressing comprises pressing the pitted area to the pressing depth for forming the first level area deeper than the depth of the plurality of pits before the concealment treatment.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
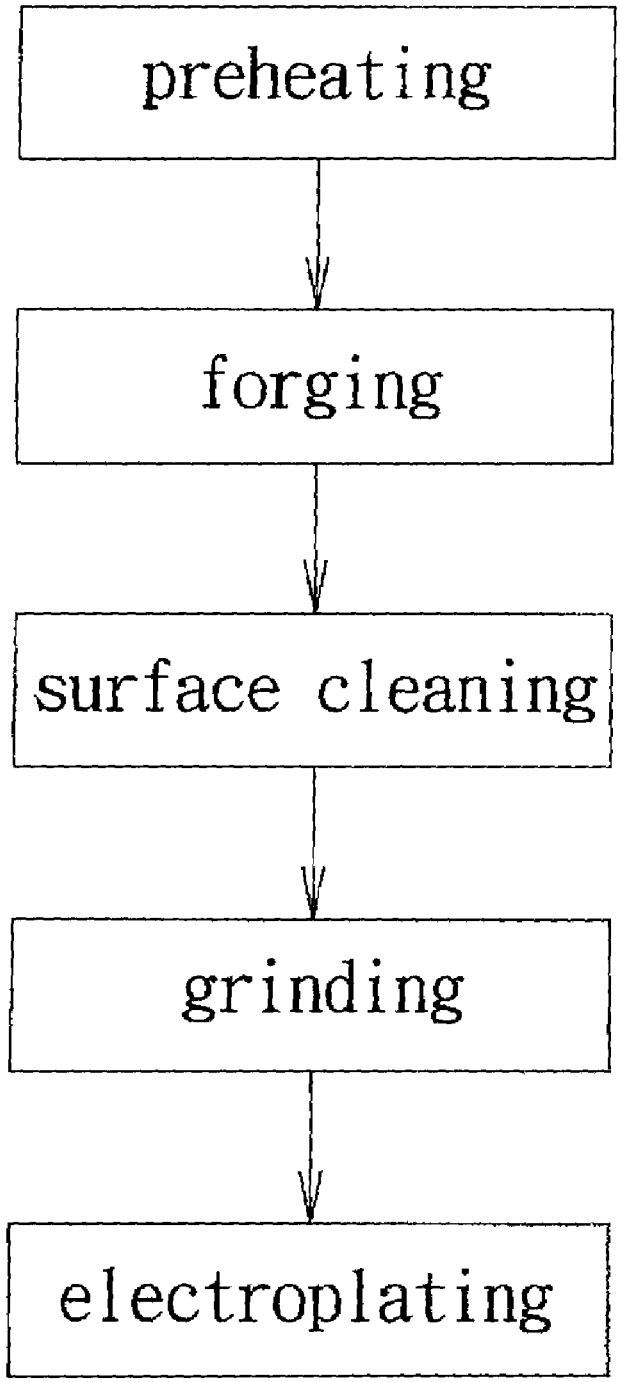
Fig. 1 PRIOR ART
FIG. 1 is a block diagram illustrating steps of a conventional method for manufacturing a wrench body.
Figure 2:
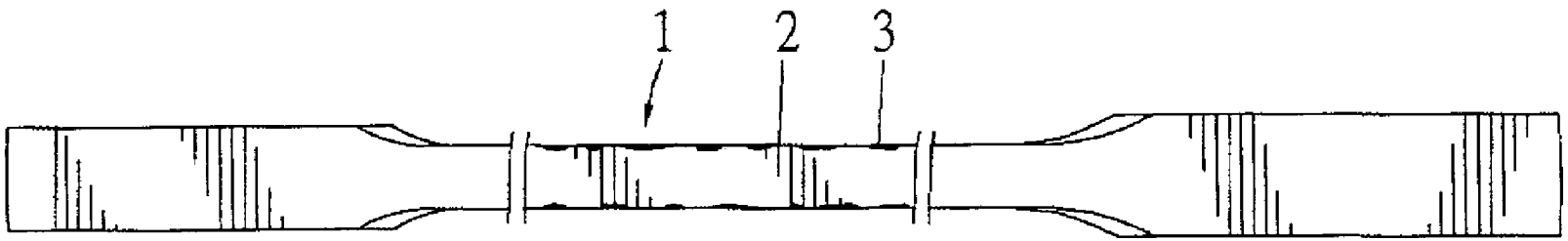
Fig. 2 PRIOR ART
FIG. 2 is a schematic side view illustrating a wrench handle after a forging step of the conventional method.
Figure 3:
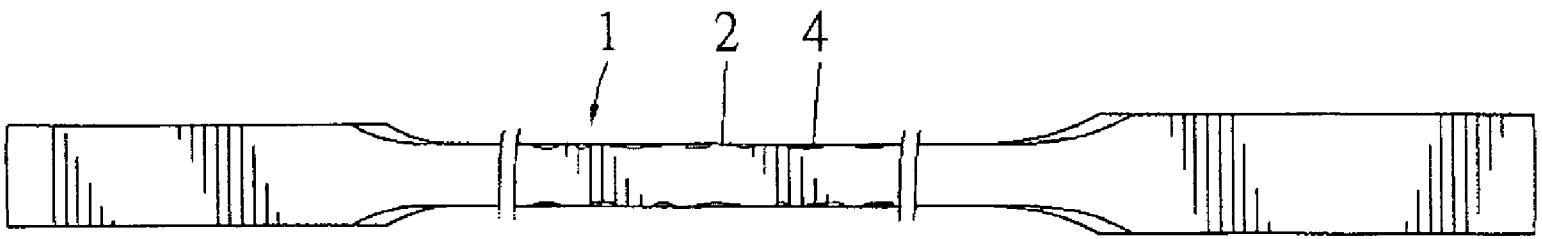
Fig. 3 PRIOR ART
FIG. 3 is a schematic side view illustrating a wrench handle after a surface cleaning step of the conventional method.
Figure 4:
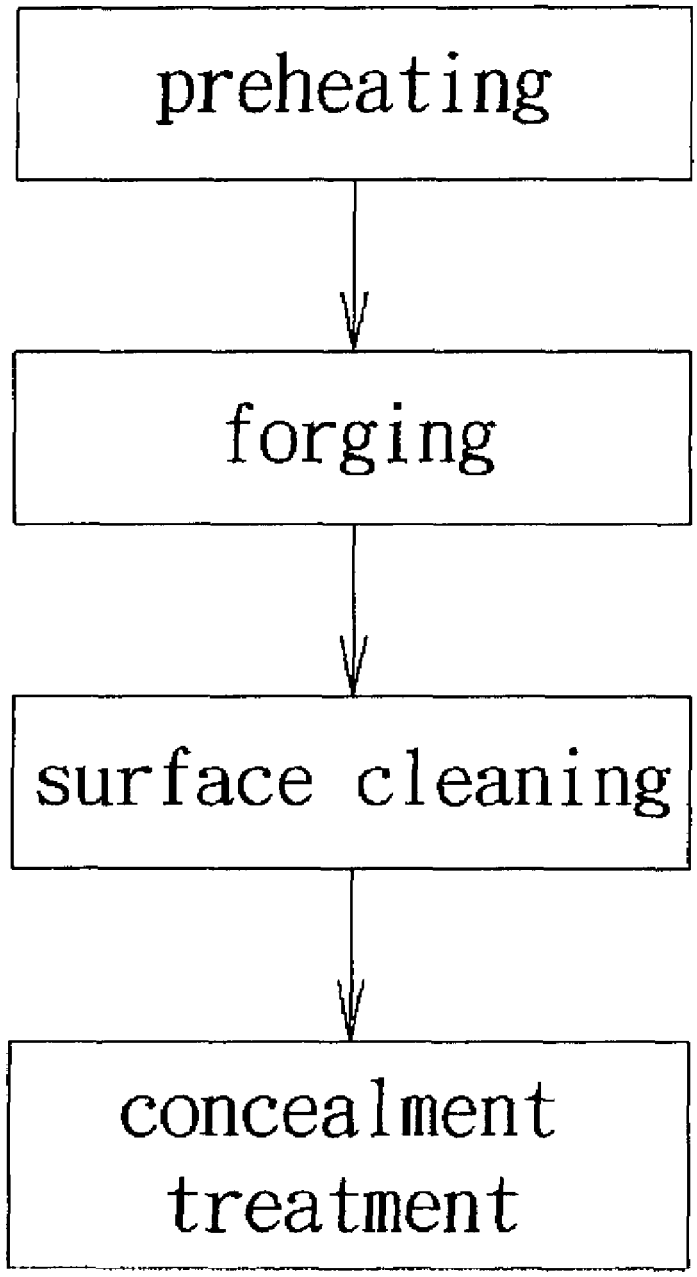
FIG. 4 is a block diagram illustrating a method for manufacturing a wrench handle accordance with the present invention.

Referring to FIG. 4, a method for manufacturing a wrench handle in accordance with the present invention comprises preheating, forging, surface cleaning (removing carbon scale), and concealment treatment by pressing.

Figure 5:
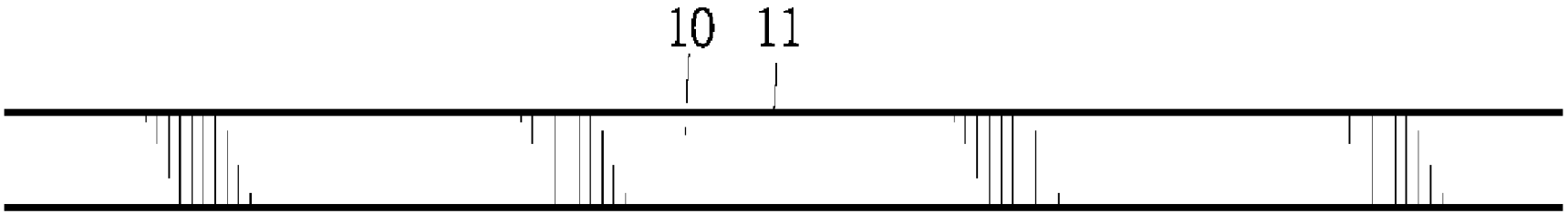
FIG. 5 is a schematic view illustrating a work piece after a preheating step of the method in accordance with the present invention.
Figure 14:
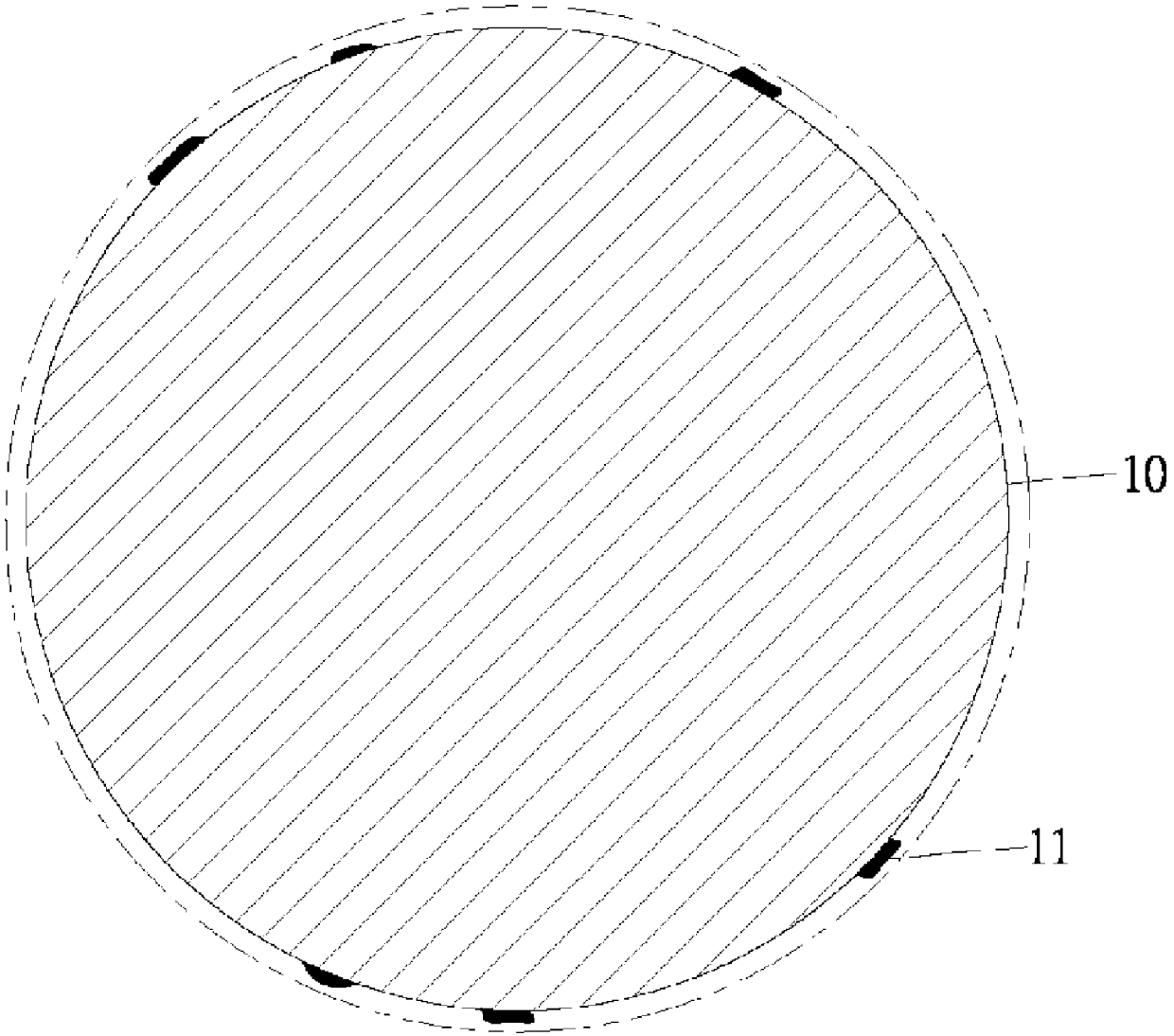
FIG. 14 is a schematic cross-section view of a work piece after preheating and before forging.

More specifically, in the first step of the method, a work piece 10 made of metal is preheated to prevent the work piece 10 from breaking during the subsequent forging procedure. A layer of carbon scale 11 is generated on a surface of the work piece 10, as shown in FIGS. 5 and 14. The depth of the layer of carbon scale is determined by the temperature of the preheating. Higher preheating temperatures will leave a thicker layer of carbon scale, while lower temperatures will leave a thinner layer of carbon scale. During preheating, the carbon scale 11 falls from the surface of the work piece 10, and new carbon scale 11 is generated on the surface of the work piece 10.

Figure 6:
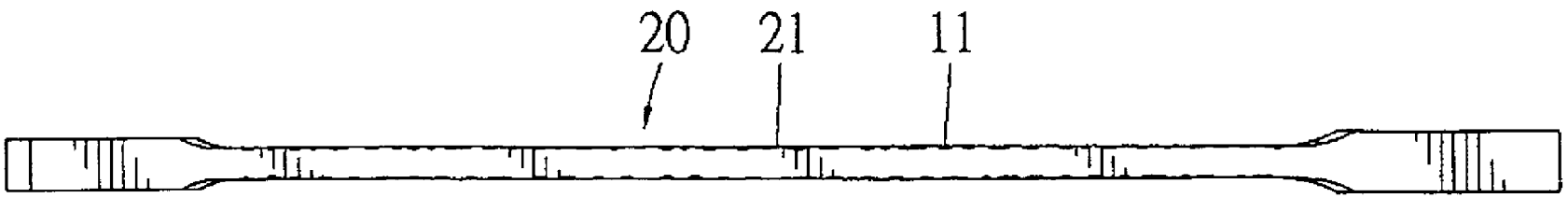
FIG. 6 is a schematic side view illustrating a wrench handle after a forging step of the method in accordance with the present invention.
Figure 7:
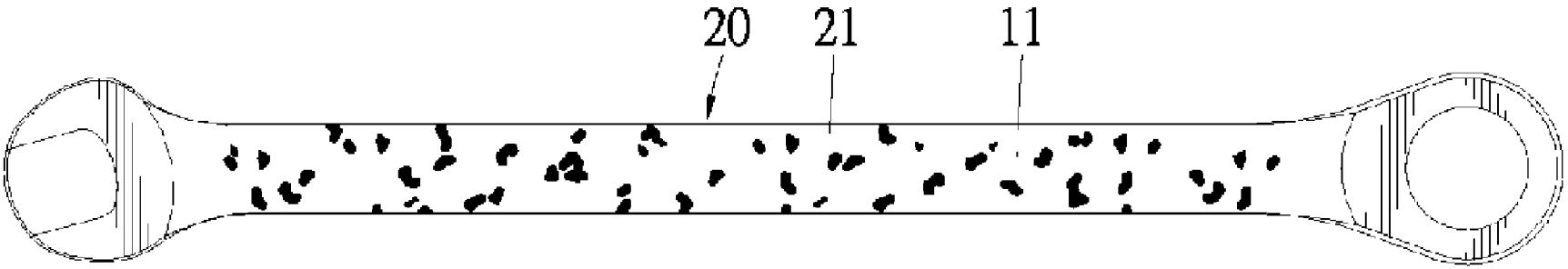
FIG. 7 is a schematic top view of the wrench handle in FIG. 6.
Figure 15:
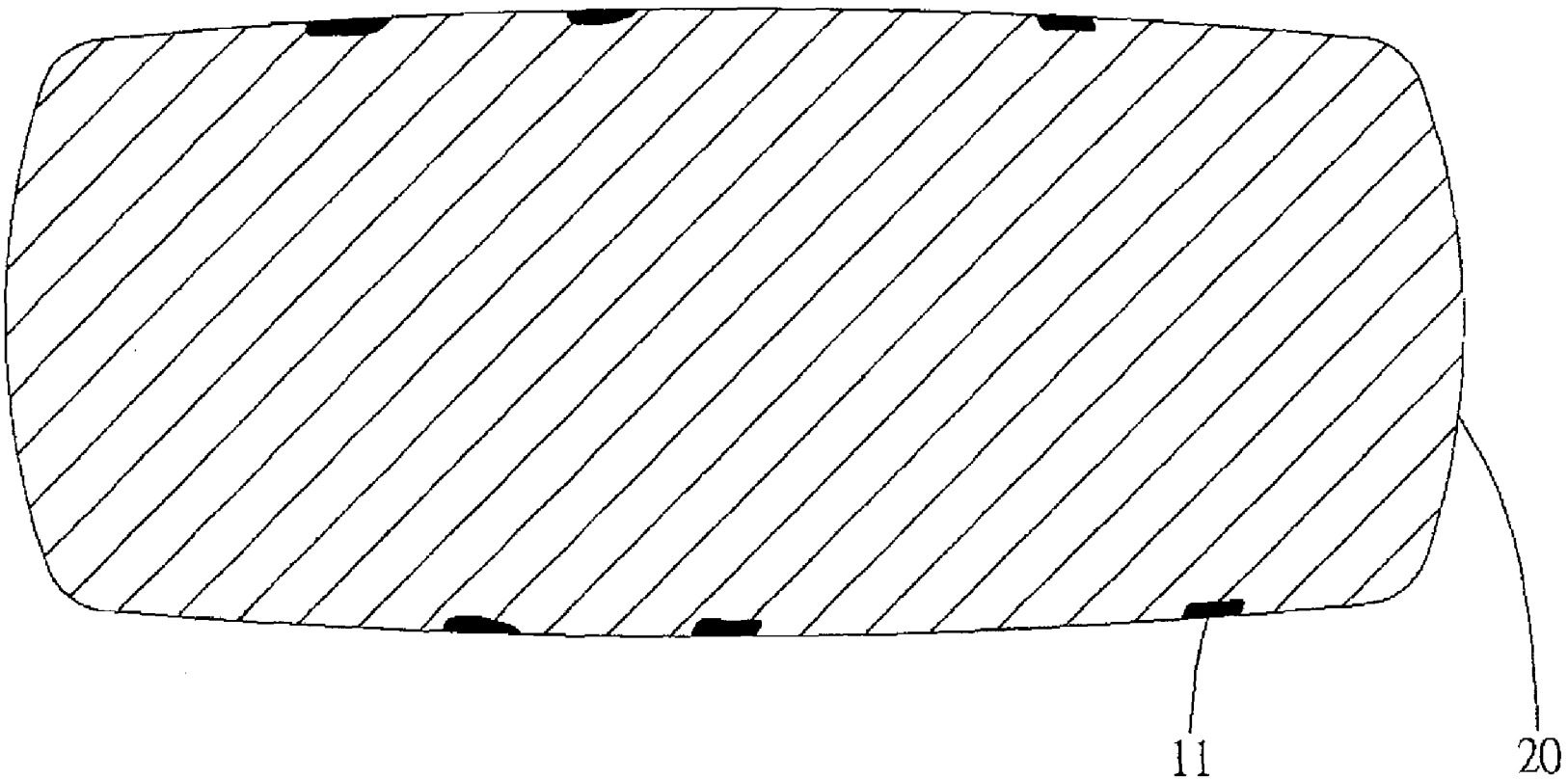
FIG. 15 is a schematic cross section of a wrench handle after forging.

The work piece 10 is then forged to form a wrench handle 20. The wrench handle in this example includes two end portions (not labeled). At least one of the end portions is configured or subsequently processed to have structure for engaging with a fastener, a socket, an adapter, etc. It is noted that some of the carbon scale 11 falls off from the surface of the work piece 10 before the forging step (see FIG. 14) and that the carbon scale 11 is not completely removed after forging. More specifically, the remaining carbon scale 11 is forged into the surface 21 of the wrench handle 20, as shown in FIGS. 6, 7, and 15.

Figure 8:
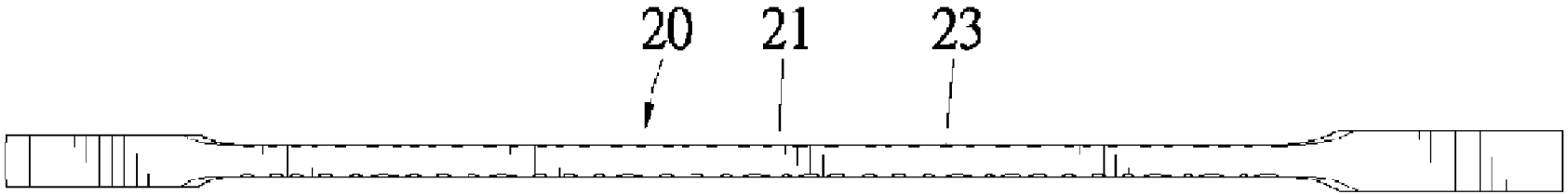
FIG. 8 is a schematic side view illustrating the wrench handle after a surface cleaning step of the method in accordance with the present invention.
Figure 9:
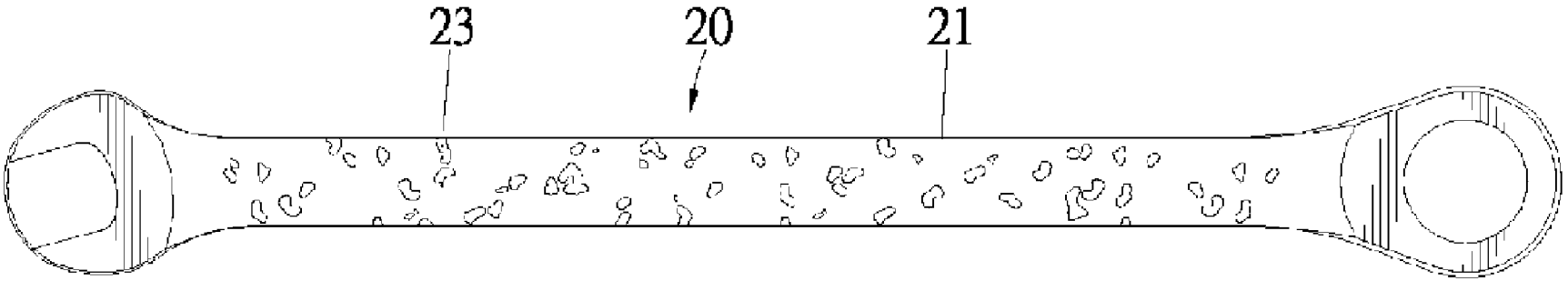
FIG. 9 is a schematic top view of the wrench handle in FIG. 8.
Figure 16:
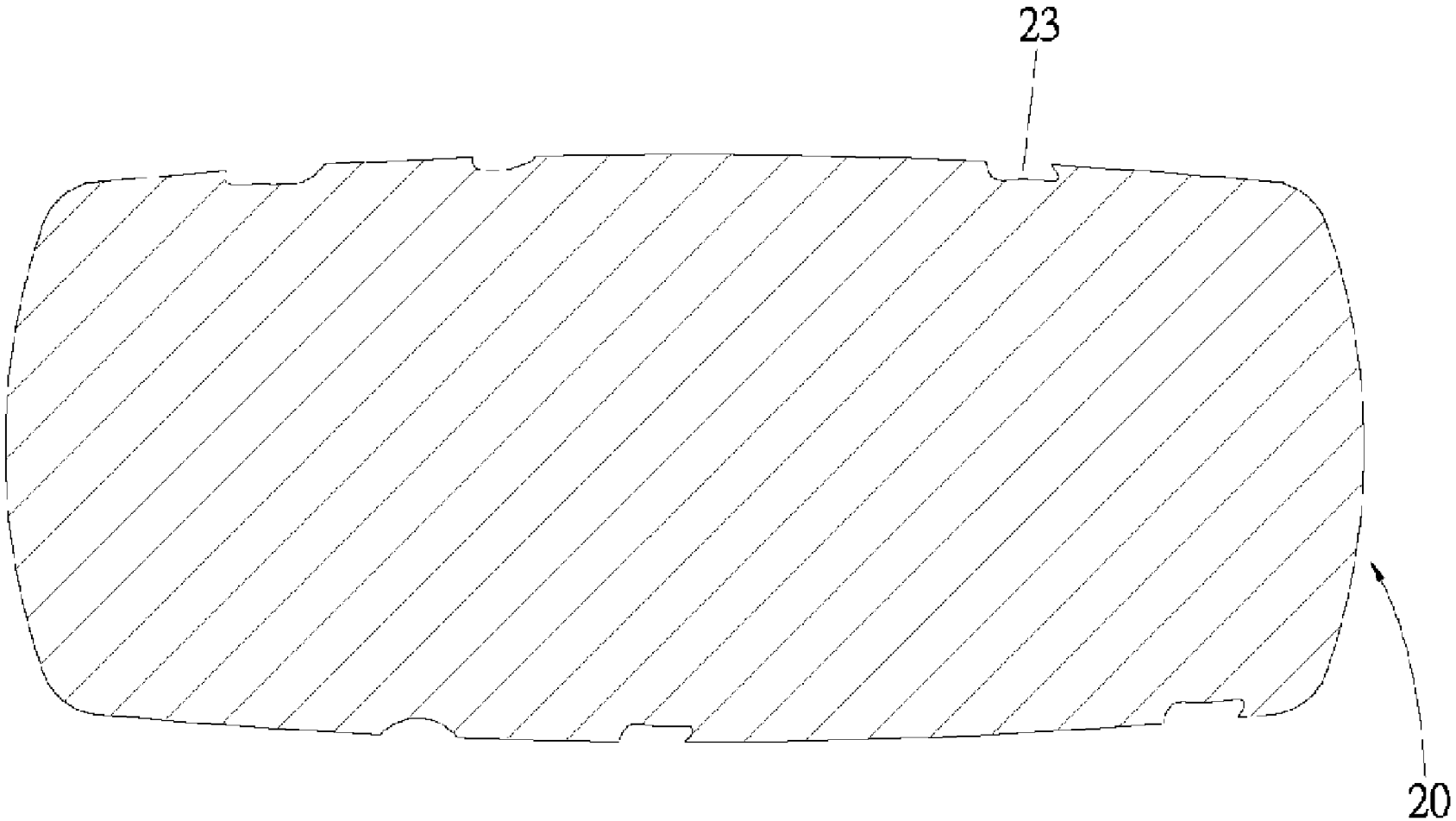
FIG. 16 is a schematic cross-section of a wrench handle after surface cleaning.

Then, a surface cleaning process such as sand-blasting, tumbling, etc is carried out on the wrench handle 20 for removing the carbon scale 11. A pitted area (not labeled) with a plurality of pits 23 are left in the surface 21 of the wrench handle 20 after the surface cleaning process, as shown in FIGS. 8, 9, and 16.

Figure 10:
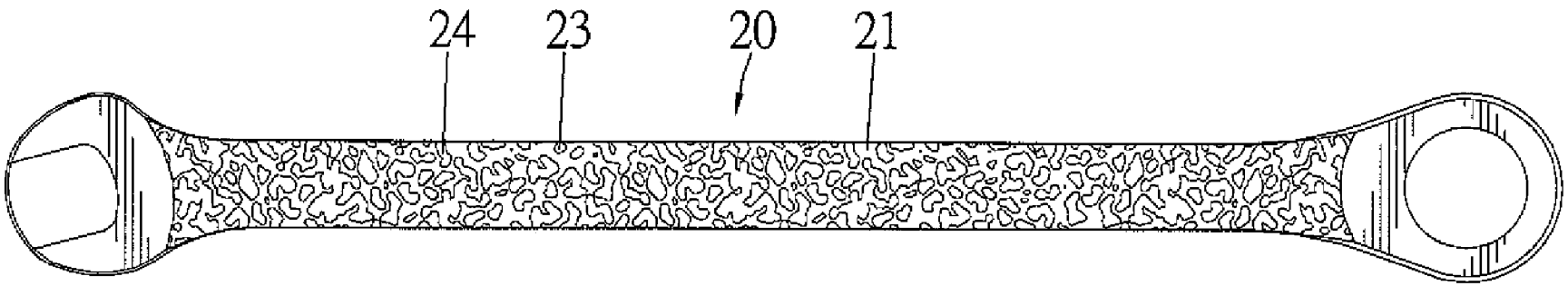
FIG. 10 is a schematic top view of the wrench handle after a concealment treatment by pressing step of the method in accordance with the present invention.
Figure 17:
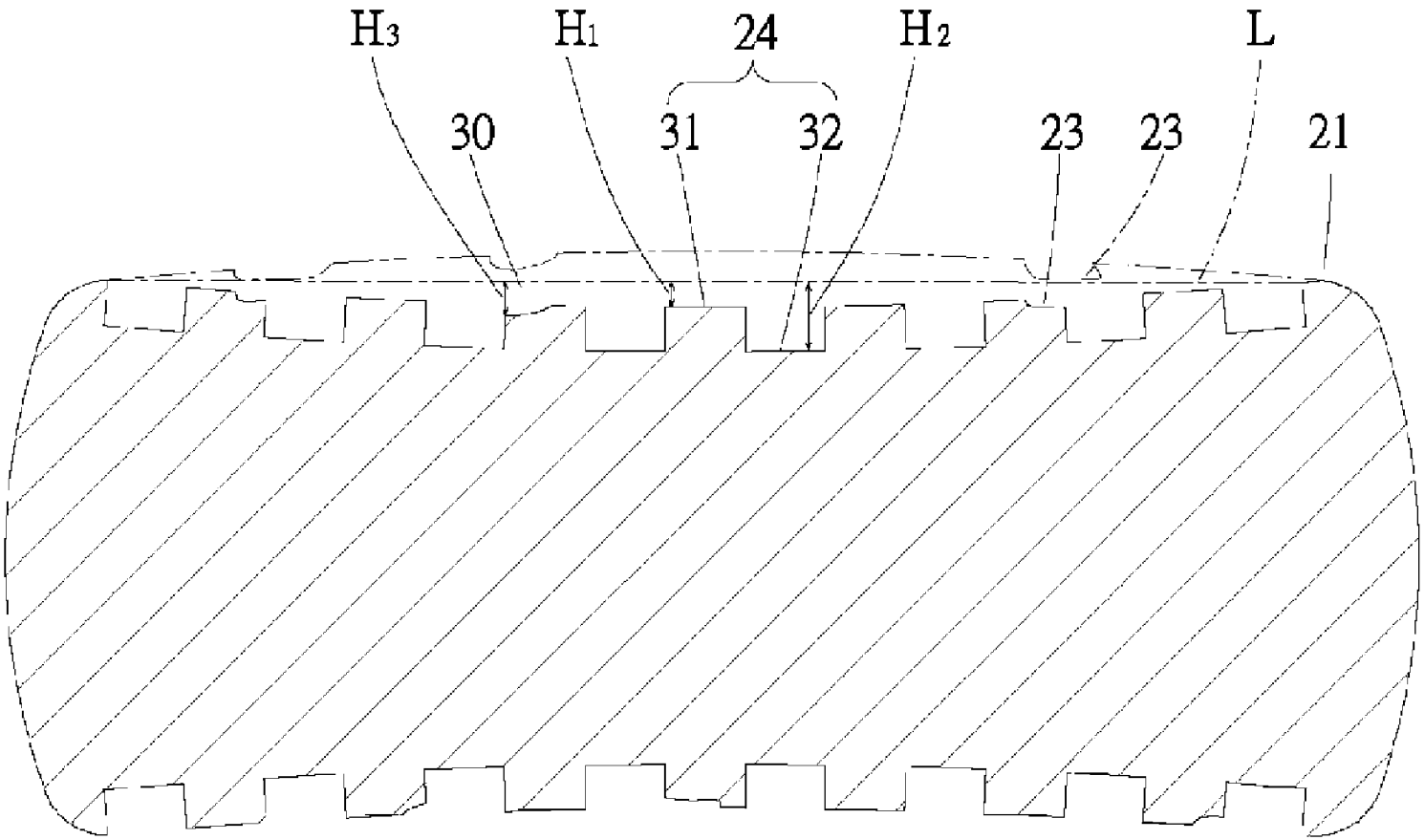
FIG. 17 is a schematic cross-section of a wrench handle after concealment treatment by pressing.

Next, the pitted area of the wrench handle 20 is pressed to provide an indentation section 30 including a plurality of regular or irregular patterns 24 on the surface 21 of the wrench handle 20, as shown in FIGS. 10 and 17. The pressing depth for forming the upper layer 31 is lower than the lowest points of the pits 23 before the concealment treatment. It is noted that the pits 23 are also pressed inward. The phantom line in FIG. 17 illustrates position of the pits 23 before pressing. After pressing, these patterns 24 conceal the pits 23 in the surface 21 of the wrench handle 20. Namely, an observer cannot perceive the pits 23 with the naked eye. Nevertheless, the pits 23 may be observed with a magnifier or the like. The patterns 24 may be formed on one or two sides of the wrench handle 20. In this example, the patterns 24 are formed on an upper face of the wrench handle 20. Preferably, the wrench handle 20 is pressed by a press (not shown) with a force of at least ten tons when forming the indentation section 30 on the wrench handle 20.

FIG. 17 shows a cross-section of the indentation section 30, and the respective heights (depths) of upper and lower areas 31 and 32 of the indentation section 30 and the pits 23. The pits 23 are shown for reference only, they are not readily visible in the indentation section 30. More specifically, the indentation section 30 includes a first level area 31 having a first depth HI to the surface (see the line L) of the wrench handle after pressing. The indentation section 30 further includes a second level area 32 located at a position different from that of the first level area 31 and having a second depth H2 to the surface of the wrench handle 20 after pressing. The second depth H2 is larger than the first depth H1. After pressing, the depth H3 of each pit 23 to the surface of the wrench handle 20 is larger than the first depth H1 and smaller than the second depth H2.

Figure 11:
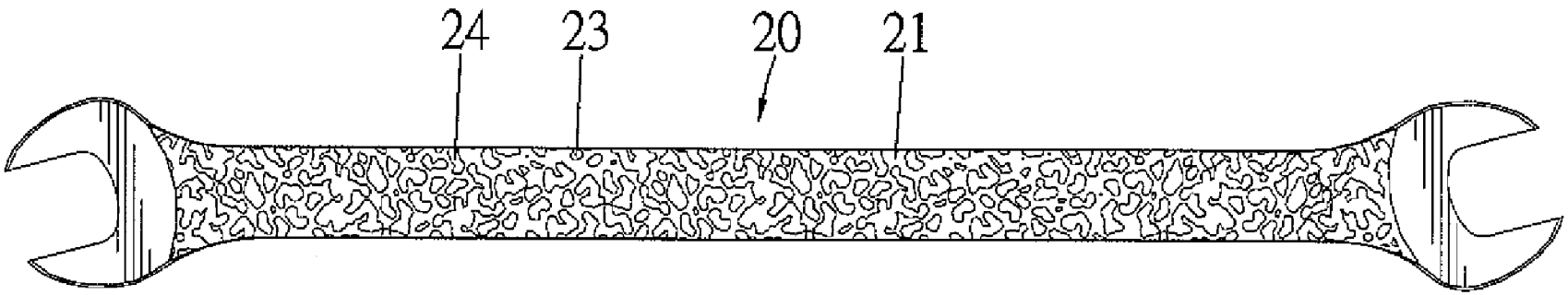
FIG. 11 is a schematic top view of another example of the final product in accordance with the present invention.
Figure 12:
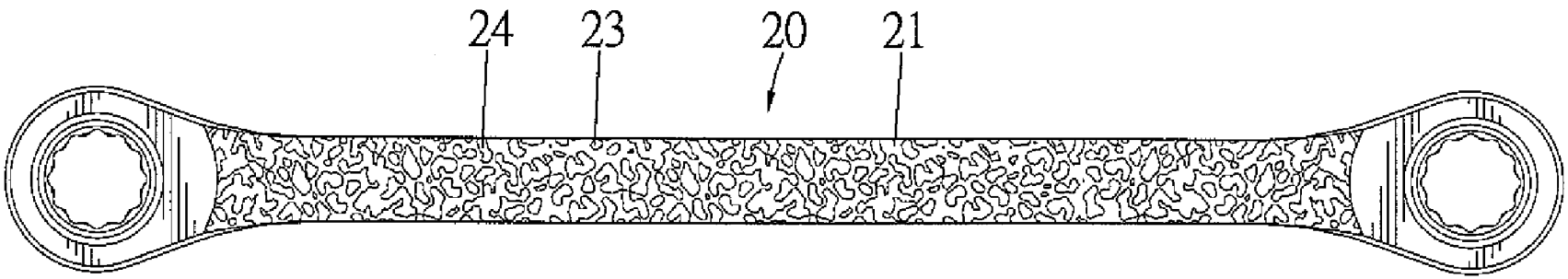
FIG. 12 is a schematic top view of a further example of the final product in accordance with the present invention.

FIGS. 11 and 12 show different final products of the wrenches manufactured by the method in accordance with the present invention.

Figure 13:
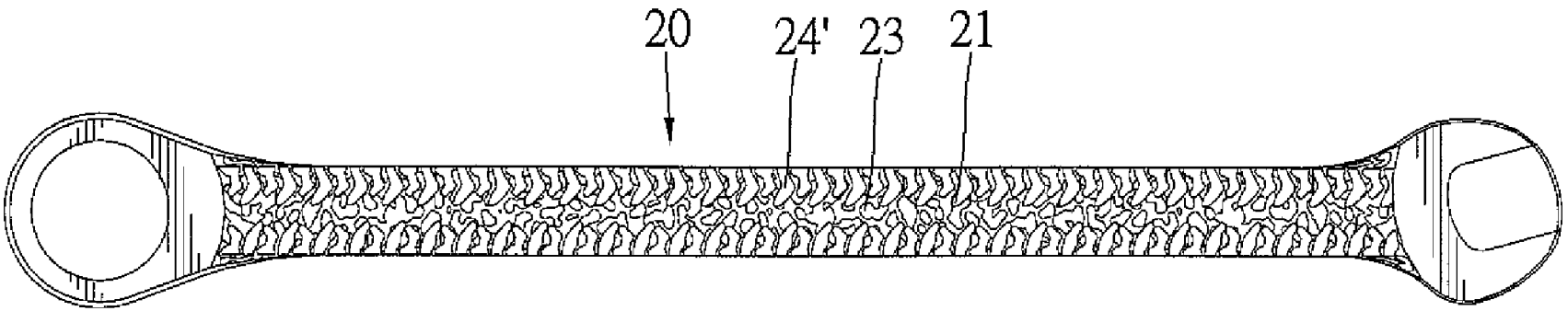
FIG. 13 is a schematic top view illustrating another example of concealment treatment by pressing in accordance with the present invention.

It is noted that the patterns 24 may have regular or irregular shapes. Further, the patterns 24 may be regularly or irregularly distributed on the surface 21 of the wrench handle 20. In the example shown in FIG. 10, the patterns 24 are irregular. In an alternative example shown in FIG. 13, the patterns 24' are regular.

A wrench handle 20 manufactured by the method in accordance with the present invention is low in cost and has a high qualified product ratio, as manual grinding is not required. Further, the patterns 24, 24' provide an aesthetically pleasing effect while effectively covering the pits 23 resulting from the carbon scale 11. Thus, the final wrench products are more attractive to the potential customers. Further, the patterns 24, 24' provide friction for the user's hand, providing a Although the wrench handle 20 manufactured by the method in accordance with the present invention needs no manual grinding; however, additional manual and/or mechanical grinding procedure(s) may be carried out after concealment treatment when desired. Further, at least a portion of the carbon scale may be removed before forging.

Although specific embodiments have been illustrated and described, numerous modifications and variations are still possible without departing from the essence of the invention. The scope of the invention is limited by the accompanying claims.

What is claimed is:

1. A method for manufacturing a wrench handle, the method comprising:

preheating a work piece made of metal, with a layer of carbon scale being generated on the work piece during preheating;

forging the work piece after preheating to form a wrench handle having at least one end for driving fasteners, with the carbon scale on the work piece being forged into a surface of the wrench handle during forging;

removing the carbon scale after forging and leaving a pitted area with a plurality of pits in the surface of the wrench handle, with each of the plurality of pits having a depth from the surface of the wrench handle; and providing a concealment treatment by pressing the pitted area of the surface of the wrench handle inward to a pressing depth after removing the carbon scale after forging and forming an indentation section on the surface of the wrench handle for covering the plurality of pits, with the indentation section including a first level area having a first depth to the surface of the wrench handle after pressing, the indentation section further including a second level area located at a position different from that of the first level area and having a second depth to the surface of the wrench handle after pressing, with the second depth being larger than the first depth, and with the depth from the surface after pressing of each of said plurality of pits being larger than the first depth and smaller than the second depth.

2. The method as claimed in claim 1 further comprising removing at least a portion of the layer of carbon scale before forging.

3. The method as claimed in claim 1 wherein removing the carbon scale includes sand-blasting or tumbling.

4. The method as claimed in claim 1 wherein providing the concealment treatment by pressing comprises pressing at least one of an upper face and a lower face opposite to the upper face of the wrench handle to form the indentation section.

5. The method as claimed in claim 1 wherein providing the concealment treatment by pressing comprises pressing with a force of at least ten tons to form the indentation section on the surface of the wrench handle.

6. The method as claimed in claim 1 wherein providing the concealment treatment by pressing comprises pressing the pitted area to the pressing depth for forming the first level area deeper than the depth of the plurality of pits before the concealment treatment.

* * * * *